US008983343B2

(12) United States Patent
Wakimoto

(10) Patent No.: US 8,983,343 B2
(45) Date of Patent: Mar. 17, 2015

(54) IMAGE FORMING APPARATUS AND TONER CASE

(71) Applicant: KYOCERA Document Solutions Inc., Osaka (JP)

(72) Inventor: Atsuhiro Wakimoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 61 days.

(21) Appl. No.: 13/867,744

(22) Filed: Apr. 22, 2013

(65) Prior Publication Data

US 2013/0279943 A1 Oct. 24, 2013

(30) Foreign Application Priority Data

Apr. 24, 2012 (JP) ..... 2012-099150

(51) Int. Cl.
*G03G 15/08* (2006.01)
*G03G 21/16* (2006.01)

(52) U.S. Cl.
CPC ..... *G03G 15/0832* (2013.01); *G03G 15/0865* (2013.01); *G03G 21/1647* (2013.01); *G03G 21/1676* (2013.01)
USPC ..... 399/262

(58) Field of Classification Search
USPC ..... 399/110, 111, 258, 262
See application file for complete search history.

(56) References Cited

U.S. PATENT DOCUMENTS

2010/0166458 A1 7/2010 Mase
2012/0213550 A1* 8/2012 Kikuchi et al. ..... 399/119

FOREIGN PATENT DOCUMENTS

JP 10-254328 A 9/1998
JP 2006-284661 A 10/2006
JP 2010-054994 A 3/2010
JP 2010-156759 A 7/2010

OTHER PUBLICATIONS

An Office Action; "Notice of Reasons for Rejection," issued by the Japanese Patent Office on Nov. 4, 2014, which corresponds to Japanese Patent Application No. 2012-099150 and is related to U.S. Appl. No. 13/867,744.

* cited by examiner

*Primary Examiner* — David Bolduc
*Assistant Examiner* — Barnabas Fekete
(74) *Attorney, Agent, or Firm* — Studebaker & Brackett PC

(57) ABSTRACT

An image forming apparatus includes a toner case and an installed part. The toner case includes a discharge port discharging a toner. To the installed part, the toner case is detachably installed. On the circumference of the toner case, a locking piece is provided. The installed part includes a locking member covering at least a part of the circumference of the toner case. The locking member has an insertion depression, an engaging piece and a biasing member. The insertion depression is arranged along an installing direction of the toner case and is capable of insertion of the locking piece. The engaging piece moves between a protrusive position protruded to the insertion depression at predetermined length and a withdrawn position withdrawn further than the protrusive position from the insertion depression in intersecting directions with the installing direction. The biasing member biases the engaging piece to the protrusive position side.

18 Claims, 16 Drawing Sheets

IMAGE FORMING APPARATUS AND TONER CASE

INCORPORATION BY REFERENCE

This application is based on and claims the benefit of priority from Japanese Patent application No. 2012-099150 filed on Apr. 24, 2012, the entire contents of which are incorporated herein by reference.

BACKGROUND

The present disclosure relates to an image forming apparatus and a toner case installed therein.

An image forming apparatus, such as an electrostatic copying machine, a laser printer or an electrostatic facsimile, carries out the development process by supplying a toner (a developer) from a development device to an electrostatic latent image formed on the surface of a photosensitive drum or the like. The toner used in such development process is supplied from a toner case, such as a toner container or an intermediate hopper, to the development device.

In the image forming apparatus, by repeatedly carrying out the above-mentioned development process, the toner in the toner case accordingly decreases, and then, when the toner in the toner case runs out, the toner case is replaced. Therefore, the toner case is detachably installed to an installed part provided in the image forming apparatus.

In order to improve operability for installing and detaching the toner case to the image forming apparatus and force for holding the toner case in the image forming apparatus, various different structures are designed so far. For example, one image forming apparatus provided with an installed part, a fixing member and a biasing member is disclosed. To the installed part, a toner case is detachably installed. The fixing member is arranged to move in an axial direction accompanying to the installing action of the toner case to the installed part. The biasing member is arranged to bias the fixing member to one side in the axial direction. In such technique, by making the toner case press an inclined face formed on the fixing member, the fixing member moves to another side in the axial direction against the biasing force of the biasing member. Then, when the bottom face of the toner case is released from the fixing member, the toner case is stopped in an engaged state by the fixing member by biasing force of the biasing member.

However, in the above-mentioned structure, it is necessary to continue pressing the toner case to the installed part side against the biasing force of the biasing member until the toner case is stopped in an engaged state by the fixing member after the toner case comes into contact with the fixing member. Therefore, a working load of workers, such as a user or a serviceman, undertaking installation/detachment work of the toner case is increased.

SUMMARY

In accordance with an embodiment of the present disclosure, an image forming apparatus includes a toner case and an installed part. The toner case includes a discharge port configured to discharge a toner. To the installed part, the toner case is detachably installed. On the circumference of the toner case, a locking piece is provided. The installed part includes a locking member configured to cover at least a part of the circumference of the toner case. The locking member has an insertion depression, an engaging piece and a biasing member. The insertion depression is arranged along an installing direction of the toner case to the installed part. The insertion depression is configured to be capable of insertion of the locking piece. The engaging piece is configured to move between a protrusive position arranged to protrude to the insertion depression at predetermined length and a withdrawn position arranged to withdraw further than the protrusive position from the insertion depression in intersecting directions with the installing direction. The biasing member is configured to bias the engaging piece to the protrusive position side. In the insertion depression, a first position, a second position being further than the first position in the installing direction and a third position being further than the second position in the installing direction are provided. While the toner case is installed to the installed part, when the locking piece is inserted to the first position, the locking piece presses the engaging piece so that the engaging piece moves from the protrusive position to the withdrawn position against biasing force of the biasing member. Then, when the locking piece is inserted to the second position, the engaging piece presses the locking piece to the far side in the installing direction by biasing force of the biasing member. And then, when the locking piece is inserted to the third position, the engaging piece stops the locking piece in an engaged state so that the movement of the locking piece toward the near side in the installing direction is restricted.

Furthermore, in accordance with an embodiment of the present disclosure, a toner case is detachably installed to an installed part of an image forming apparatus. The toner case includes a discharge port configured to discharge a toner and a locking piece provided on its circumference. The installed part of the image forming apparatus includes a locking member configured to cover at least apart of the circumference of the toner case. The locking member includes an insertion depression, an engaging piece and a biasing member. The insertion depression is arranged along an installing direction of the toner case to the installed part. The insertion depression is configured to be capable of insertion of the locking piece. The engaging piece is configured to move between a protrusive position arranged to protrude to the insertion depression at predetermined length and a withdrawn position arranged to withdraw further than the protrusive position from the insertion depression in intersecting directions with the installing direction. The biasing member is configured to bias the engaging piece to the protrusive position side. In the insertion depression, a first position, a second position being further than the first position in the installing direction and a third position being further than the second position in the installing direction are provided. While the toner case is inserted to the installed part, when the locking piece is inserted to the first position, the locking piece presses the engaging piece so that the engaging piece moves from the protrusive position to the withdrawn position against biasing force of the biasing member. Then, when the locking piece is inserted to the second position, the engaging piece presses the locking piece to the far side in the installing direction by biasing force of the biasing member. And then, when the locking piece is inserted to the third position, the engaging piece stops the locking piece in an engaged state so that the movement of the locking piece toward the near side in the installing direction is restricted.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
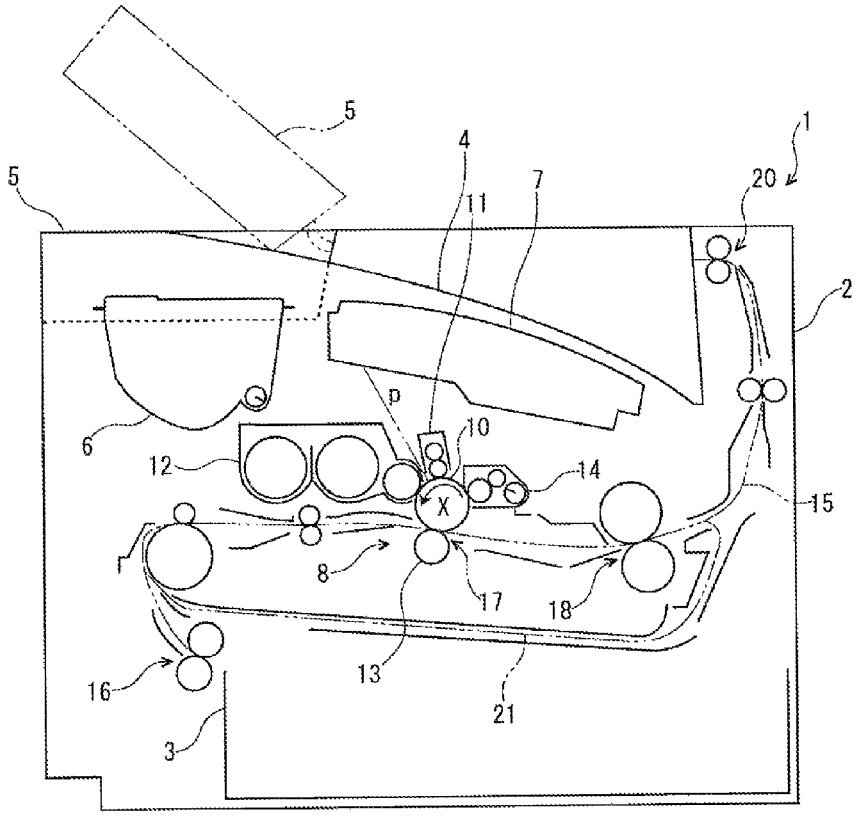
FIG. 1 is a schematic diagram schematically showing a printer according to an embodiment of the present disclosure.

With reference to FIG. 1, the entire structure of an electrographic printer 1 as an image forming apparatus will be described. FIG. 1 is a schematic diagram schematically showing the printer according to an embodiment of the present disclosure. Hereinafter, it will be described so that the front side of the printer 1 is positioned at the left-hand side of FIG. 1.

The printer 1 includes a box-formed printer main body 2. In a lower part of the printer main body 2, a sheet feeding cartridge 3 configured to store sheets (not shown) is installed and, on the top surface of the printer main body 2, an ejecting tray 4 is mounted. On the top surface of the printer main body 2, an upper cover 5 is openably/closably attached in front of the sheet ejecting tray 4 and, below the upper cover 5, a toner container 6 as a toner case is installed.

In an upper part of the printer main body 2, an exposure device 7 is installed below the sheet ejecting tray 4. The exposure device 7 is composed of a laser scanning unit (LSU). Below the exposure device 7, an image forming unit 8 is installed. In the image forming unit 8, a photosensitive drum 10 as an image carrier is rotatably installed. Around the photosensitive drum 10, a charger 11, a development device 12, a transfer roller 13 and a cleaning device 14 are located along a rotating direction (refer to arrow X in FIG. 1) of the photosensitive drum 10.

In the printer main body 2, a sheet conveying path 15 is arranged. At an upper stream end of the conveying path 15, a sheet feeder 16 is positioned and, at an intermediate stream part of the conveying path 15, a transferring unit 17 constructed of the photosensitive drum 10 and the transfer roller 13 is positioned. Furthermore, at a lower stream part of the conveying path 15, a fixing device 18 is positioned and, at a lower stream end of the conveying path 15, a sheet ejecting unit 20 is positioned. Below the conveying path 15, an inversion path 21 for duplex printing is arranged.

Next, the operation of forming an image by the printer 1 having such a configuration will be described.

When the power is supplied to the printer 1, various parameters are initialized and initial determination, such as temperature determination of the fixing device 18, is carried out. Subsequently, in the printer 1, when image data is inputted and a printing start is directed from a computer or the like connected with the printer 1, image forming operation is carried out as follows.

First, the surface of the photosensitive drum 10 is electrically charged by the charger 11. Then, exposure corresponding to the image data on the photosensitive drum 10 is carried out by a laser (refer to two-dot chain line P in FIG. 1) from the exposure device 7, thereby forming an electrostatic latent image on the surface of the photosensitive drum 10. Subsequently, the electrostatic latent image is developed to a toner image with a toner (a developer) in the development device 12.

On the other hand, a sheet fed from the sheet feeding cartridge 3 by the sheet feeder 16 is conveyed to the transferring unit 17 in a suitable timing for the above-mentioned image forming operation, and then, the toner image on the photosensitive drum 10 is transferred onto the sheet in the transferring unit 17. The sheet with the transferred toner image is conveyed to a lower stream on the conveying path 15 to go forward to the fixing device 18, and then, the toner image is fixed on the sheet in the fixing device 18. The sheet with the fixed toner image is ejected from the sheet ejecting unit 20 to the sheet ejecting tray 4. Toner remained on the photosensitive drum 10 is collected by the cleaning device 14.

Figure 2:
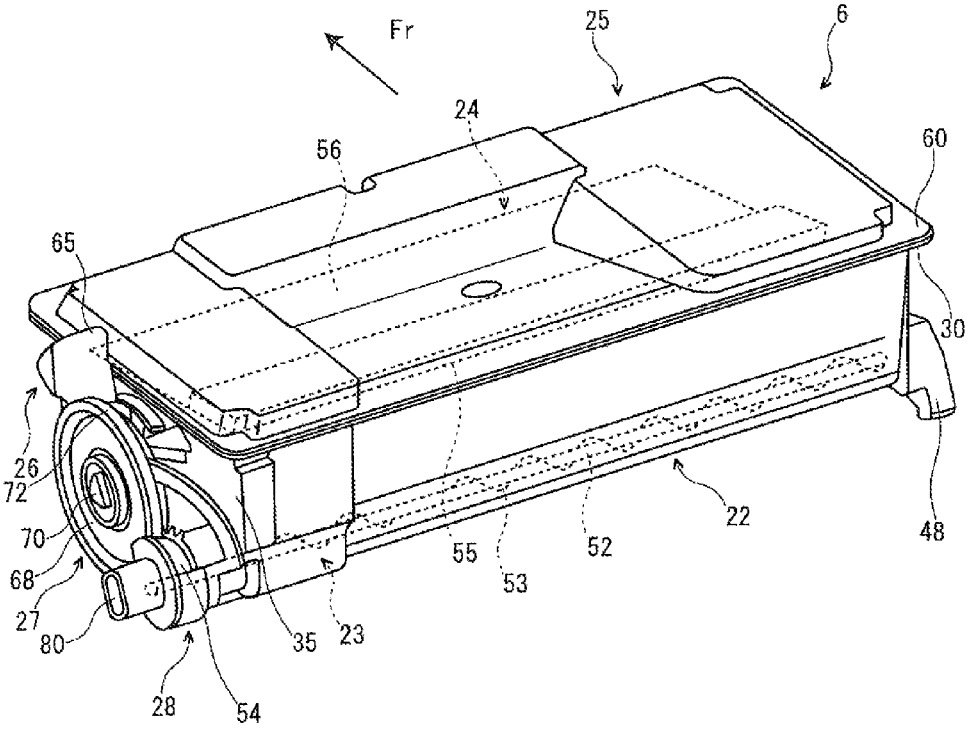
FIG. 2 is a back right perspective view showing a toner container in the printer according to the embodiment of the present disclosure.
Figure 3:
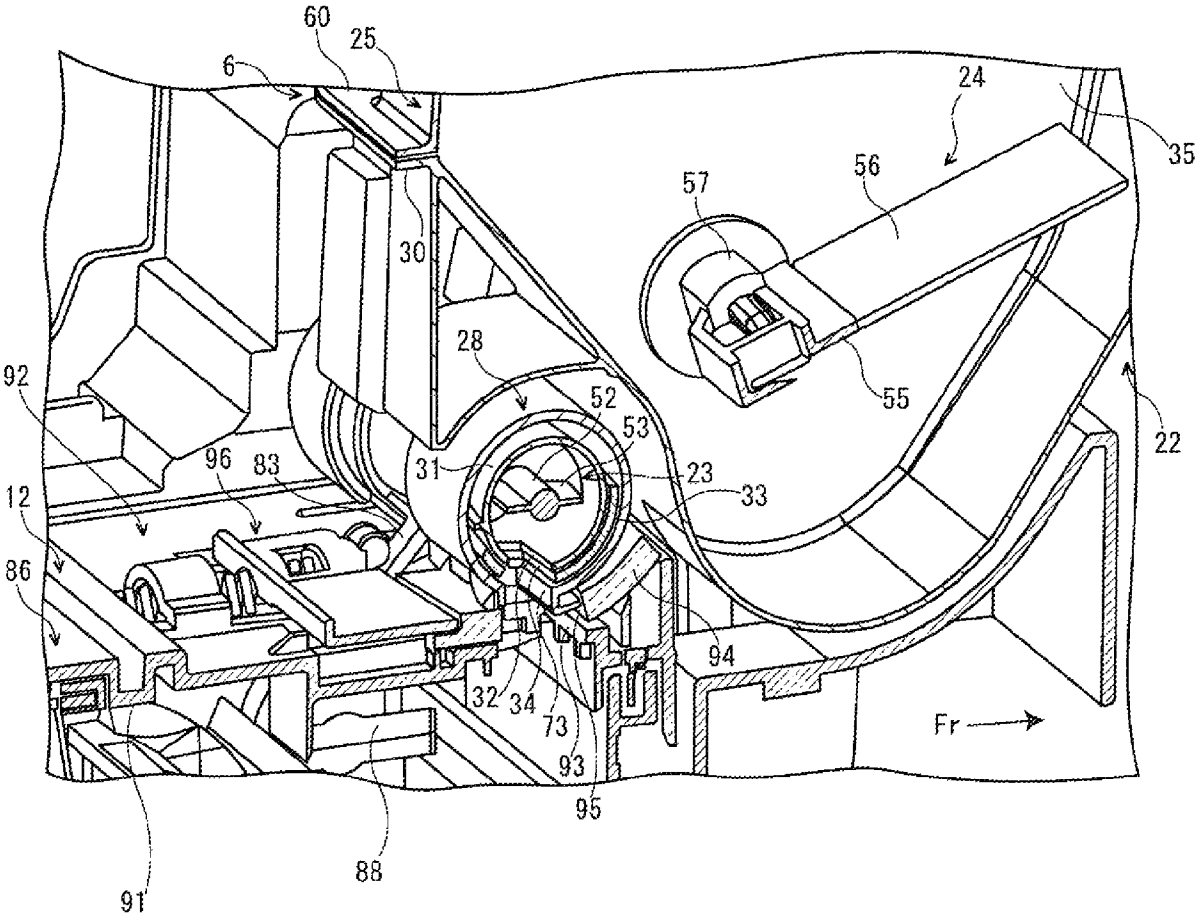
FIG. 3 is a back left perspective sectional view showing the printer in a situation, in which a case side shutter opens a discharge port and a development device side shutter opens a replenishment port, according to the embodiment of the present disclosure.
Figure 4:
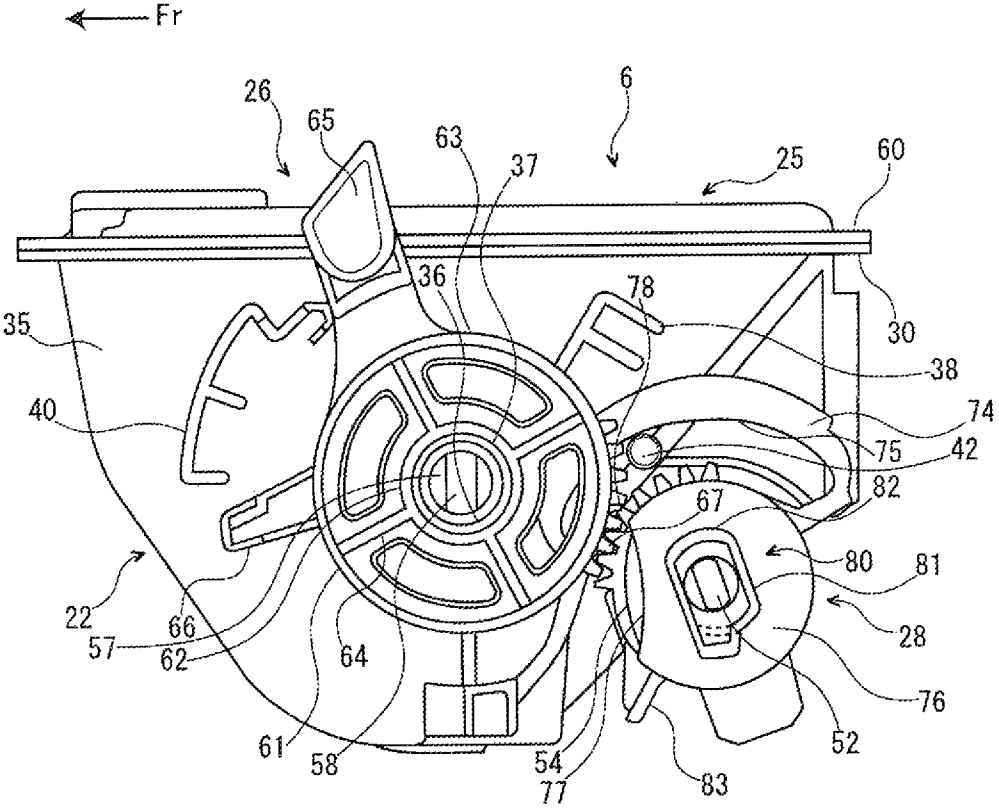
FIG. 4 is a right side view the toner container in the printer according to the embodiment of the present disclosure.
Figure 5:
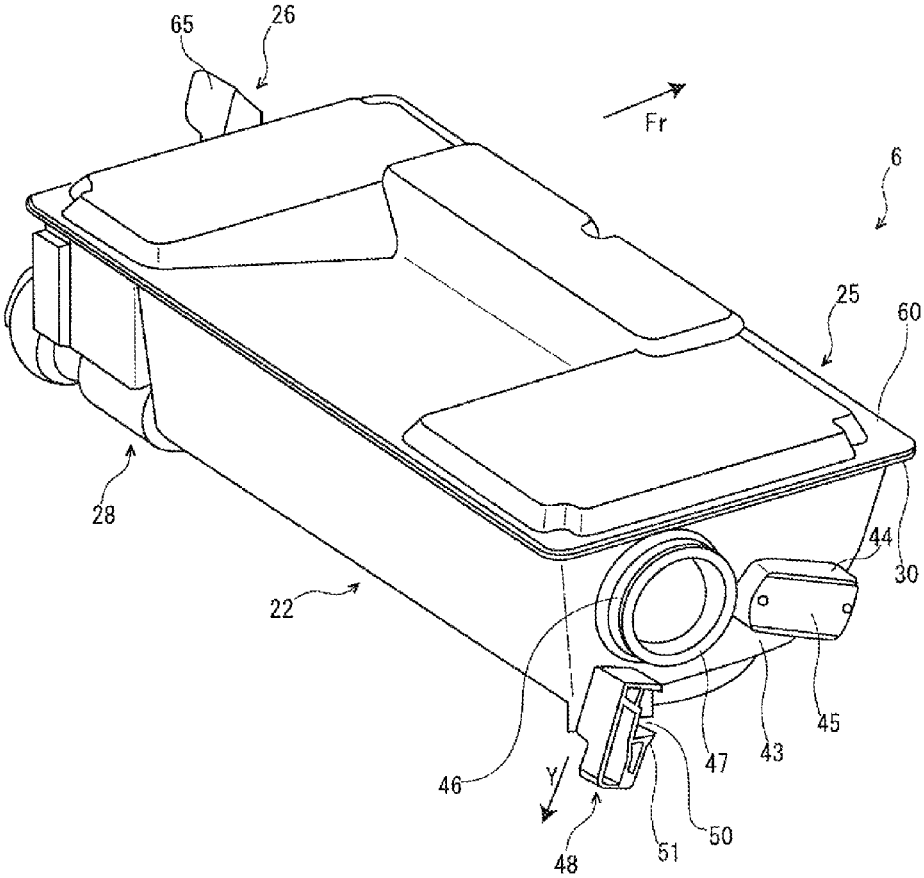
FIG. 5 is a back left perspective view showing the toner container in the printer according to the embodiment of the present disclosure.
Figure 6:
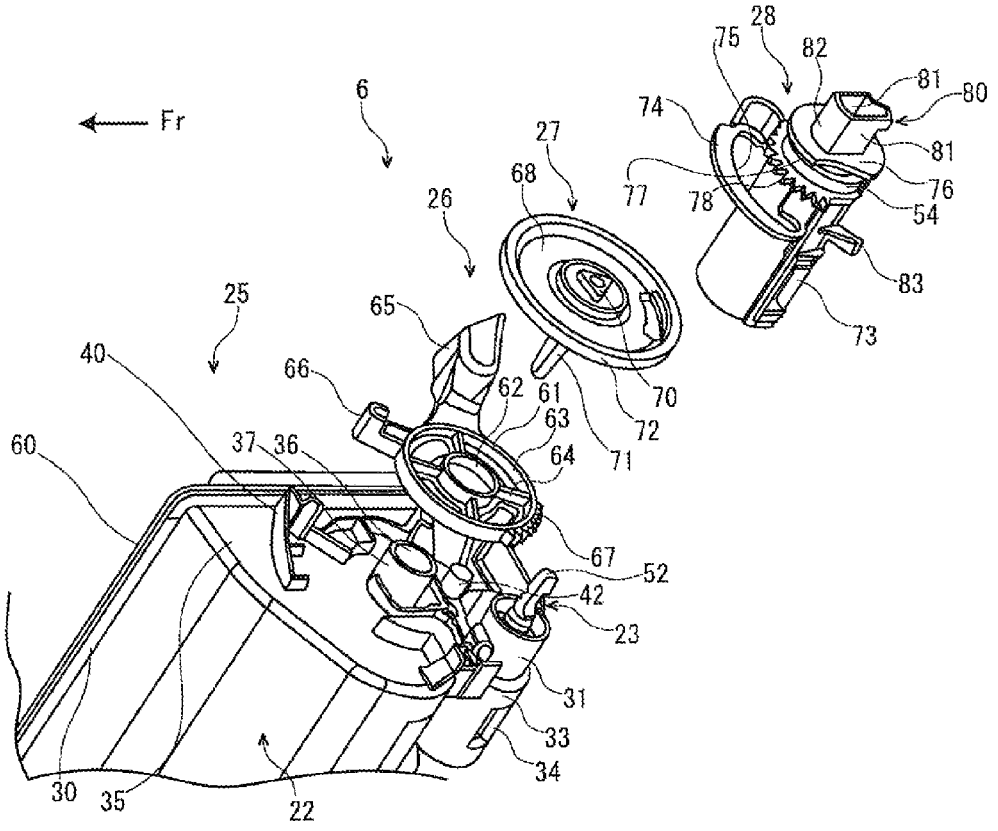
FIG. 6 is an exploded perspective view the toner container in the printer according to the embodiment of the present disclosure.

Next, with reference to FIGS. 2-6, the toner container 6 will be described in detail. FIG. 2 is a back right perspective view showing the toner container in the printer according to the embodiment of the present disclosure. FIG. 3 is a back left perspective sectional view showing the printer in a situation, in which a case side shutter opens a discharge port and a development device side shutter opens a replenishment port, according to the embodiment of the present disclosure. FIG. 4 is a right side view the toner container in the printer according to the embodiment of the present disclosure. FIG. 5 is a back left perspective view showing the toner container in the printer according to the embodiment of the present disclosure. FIG. 6 is an exploded perspective view the toner container in the printer according to the embodiment of the present disclosure.

Figure 7:
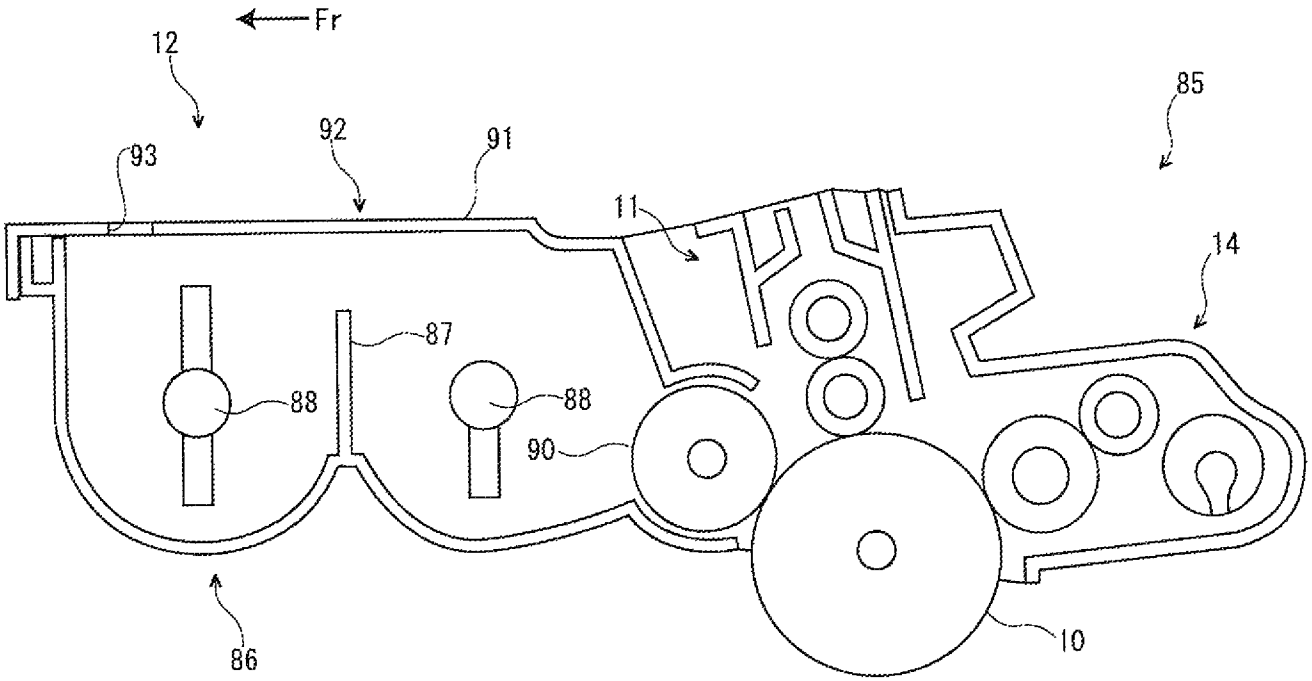
FIG. 7 is a schematic diagram schematically showing an image forming unit in the printer according to an embodiment of the present disclosure.

Arrow Fr suitably put on each figure indicates the front side of the printer 1 (FIG. 7 and more are also illustrated similarly). FIG. 2 is the back right sectional view, FIG. 3 is the back left perspective sectional view and FIG. 5 is the back left perspective view. Therefore, in FIGS. 2, 3 and 5, the left-hand and right-hand sides of the figure are converse to the actual left-hand and right-hand sides.

As shown in FIG. 2, the toner container 6 includes a box-formed case main body 22 with a opened top surface, a conveying screw 23, a stirring paddle 24, a covering body 25, a lever 26, a transmitting member 27 and a case side shutter 28. The conveying screw 23 is installed in a lower rear part of the case main body 22. The stirring paddle 24 is installed near a center part of the case main body 22. The covering body 25 covers the top surface of the case main body 22. The lever 26 is attached to a right end of the case main body 22. The transmitting member 27 is placed on the right end of the case main body 22 together with the lever 26. The case side shutter 28 is attached on a lower rear part of the right end of the case main body 22. The transmitting member 27 is omitted in FIG. 4.

The case main body 22 is formed in an extended-shape in left and right directions or a horizontal direction to contain the toner. On the circumference of a top end of the case main body 22, a main body side flange 30 is formed. As shown in FIG. 3, at the right bottom end of the case main body 22, a cylinder-formed discharge duct 31 is protruded to a right direction and, in a bottom of the discharge duct 31, a discharge port 32 configured to discharge the toner is bored. On the circumference of a lower part of the discharge duct 31, a sealing member 33 is attached and, in the sealing member 33, a communication port 34 is bored at a correspondent position to the discharge port 32.

As shown in FIG. 4, at the center of a right end wall 35 of the case main body 22, a cylinder-formed boss 37 having a penetrated hole 36 is protruded to a right direction (an outside direction). On a right surface (an outside surface) of the right end wall 35 of the case main body 22, a first restrain rib 38 is protruded to an upper backward direction of the boss 37. On the right surface of the right end wall 35 of the case main body 22, a second restrain rib 40 is protruded to an upper forward direction of the boss 37. On the right surface of the right end wall 35 of the case main body 22, a columnar protrusion 42 is formed below the first restrain rib 38.

As shown in FIG. 5, in a front part of a left end wall 43 of the case main body 22, a pedestal 44 is protruded to a left direction (an outside direction), and on the pedestal 44, an integrated circuit (IC) tag 45 for wireless communications is fixedly attached. In a rear part of the left end wall 43 of the case main body 22, a toner filling port 46 is formed behind the pedestal 44 and the toner filling port 46 is closed by a cap 47.

On a left surface (corresponding to a part of the circumference of the toner container 6) of the left end wall 43 of the case main body 22, a locking piece 48 is attached below and behind the toner filling port 46. The locking piece 48 is formed in an extended-shape in a lower backward inclined direction (hereinafter, called an installing direction; refer to arrow Y in FIG. 5). In an upper part of a front surface of the locking piece 48, a depression 50 is formed, and below the depression 50, an engaging protrusion 51 is protruded in a front direction.

As shown in FIG. 2 and other figure, the conveying screw 23 is formed in an extended-shape in the horizontal direction. The conveying screw 23 includes a bar-formed rotating shaft 52 and a spiral fin 53 concentrically mounted on the circumference of the rotating shaft 52. As shown in FIG. 3, right side parts of the rotating shaft 52 and spiral fin 53 are inserted into the discharge duct 31. A right end of the rotating shaft 52 protrudes from the discharge duct 31 in the right direction and, onto the protruding part, a conveying gear 54 (refer to FIG. 2) is fixedly attached.

As shown in FIG. 2, the stirring paddle 24 is located above and in front of the conveying screw 23 and formed in an extended-shape in the horizontal direction. The stirring paddle 24 includes a frame plate-formed supporting frame 55 and a sheet-formed stirring fin 56 supported by the supporting frame 55. Left and right ends of the supporting frame 55 are pivotally supported by the right end wall 35 and left end wall 43 of the case main body 22 via bearings 57 (refer to FIG. 3). Hereinafter, each bearing 57 is called as "a bearing 57 of a stirring paddle 24"). As shown in FIG. 4 and other figure, on the bearing 57 of the stirring paddle 24 attached onto the right end wall 35, an engaging reception 58 is formed at a correspondent position to the penetrated hole 36 of the boss 37. The stirring fin 56 is formed out of plastic sheet, e.g. lumirror.

As shown in FIG. 2, on the circumference of the covering body 25, a covering body side flange 60 is formed in the correspondent form to the main body side flange 30 of the case main body 22. The main body side flange 30 and covering body side flange 60 are ultrasonic-welded together so that the case main body 22 and covering body 25 are unified.

As shown in FIG. 4 and other figure, the lever 26 includes a lever main body 61 with a circular profile in a side view. The lever main body 61 includes a small-diameter cylinder 62, a large-diameter cylinder 63 attached around the circumference of the small-diameter cylinder 62 and four radially extended connecters 64 connecting the small-diameter cylinder 62 and large-diameter cylinder 63 with each other.

The small-diameter cylinder 62 is fitted onto the circumference of the boss 37 arranged on the right end wall 35 of the case main body 22. Accordingly, the lever 26 is rotatably supported onto the case main body 22. On an upper part of the large-diameter cylinder 63, a gripper 65 is protruded. On the large-diameter cylinder 63, a protruding piece 66 is formed in front of the gripper 65. On the circumference of a lower rear part of the large-diameter cylinder 63, a lever side gear 67 is formed.

As shown in FIG. 6 and other figure, the transmitting member 27 includes a disc-formed transmitting member main body 68. On aright surface (an outside surface) of the transmitting member main body 68, a transmission coupling 70 is protruded in the form of a triangle pole in a side view. On a left surface (an inside surface) of the transmitting member main body 68, an engaging piece 71 is protruded. The engaging piece 71 is inserted into the penetrated hole 36 formed in the boss 37 of the case main body 22, and then, engaged with the engaging reception 58 (refer to FIG. 4 and other figure) formed on the bearing 57 of the stirring paddle 24. Accordingly, the transmitting member 27 and stirring paddle 24 are connected with each other to rotate in a body.

As shown in FIG. 2, on the circumference of the transmitting member main body 68, a transmission gear 72 is formed. The transmission gear 72 meshes with the conveying gear 54 fixedly attached onto the rotating shaft 52 of the conveying screw 23, thereby rotating the conveying screw 23 in accordance with the rotation of the transmitting member 27.

As shown in FIG. 6, the case side shutter 28 is formed in a cylinder-liked shape. The case side shutter 28 is rotatably fitted onto the circumference of the discharge duct 31 of the case main body 22. In a lower surface of the case side shutter 28, a discharge aperture 73 is bored. As shown in FIG. 3 and other figure, the discharge aperture 73 is formed at a correspondent position to the discharge port 32 of the case main body 22 and the communication port 34 of the sealing member 33.

As shown in FIG. 4 and other figure, on the case side shutter 28, a roughly fan-formed guiding piece 74 is protruded. In the guiding piece 74, an arc-formed guiding hole 75 is formed and, with the guiding hole 75, the protrusion 42 of the case main body 22 is engaged.

As shown in FIG. 6 and other figure, in the case side shutter 28, a gear box 76 is attached and the gear box 76 houses the conveying gear 54. In the gear box 76, a communication aperture 77 is formed so that it is possible to house the conveying gear 54 in the gear box 76 via the communication aperture 74.

As shown in FIG. 4 and other figure, the case side shutter 28 is provided with a shutter side gear 78. The shutter side gear 78 meshes with the lever side gear 67 of the lever 26, thereby turning the case side shutter 28 in the opposite direction to the lever 26 in accordance with the turn of the lever 26. On the right end of the case side shutter 28, a fixing piece 80 is attached. The fixing piece 80 includes a pair of plane parts 81 facing to each other and a pair of curving parts 82, each of which is connected with respective ends of the plane parts 81. The fixing piece 80 is formed with an elliptic section. Outside a lower part of the case side shutter 28, a pressing protrusion 83 is formed.

Figure 8:
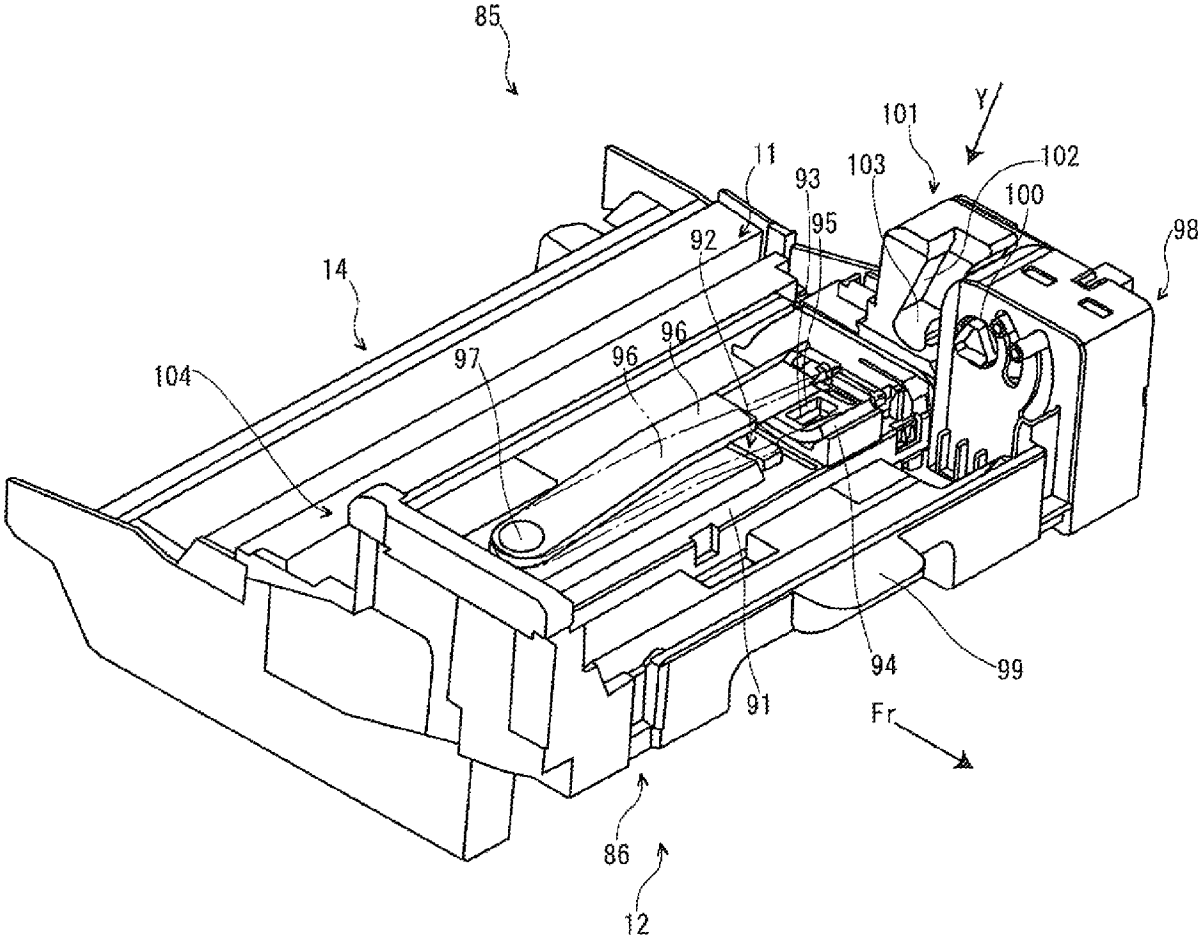
FIG. 8 is a front left perspective view showing the image forming unit in the printer according to the embodiment of the present disclosure.
Figure 9:
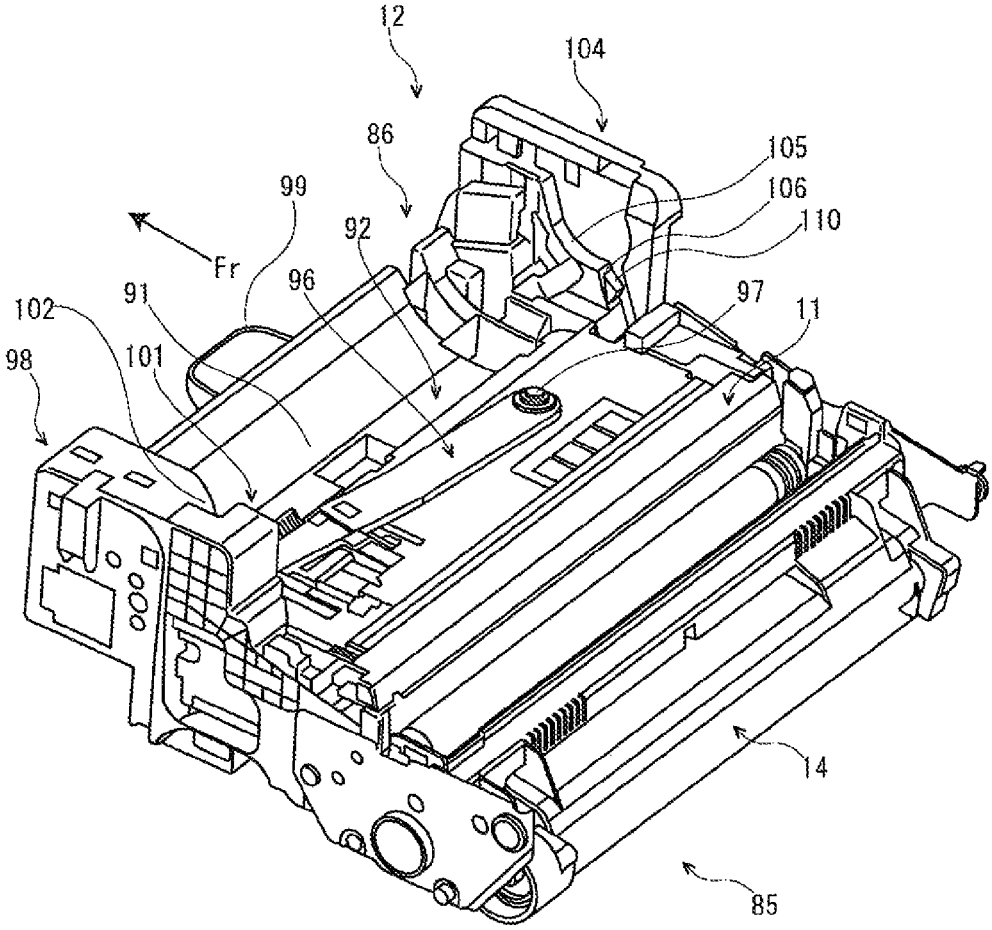
FIG. 9 is a back right perspective view showing the image forming unit in the printer according to the embodiment of the present disclosure.
Figure 10:
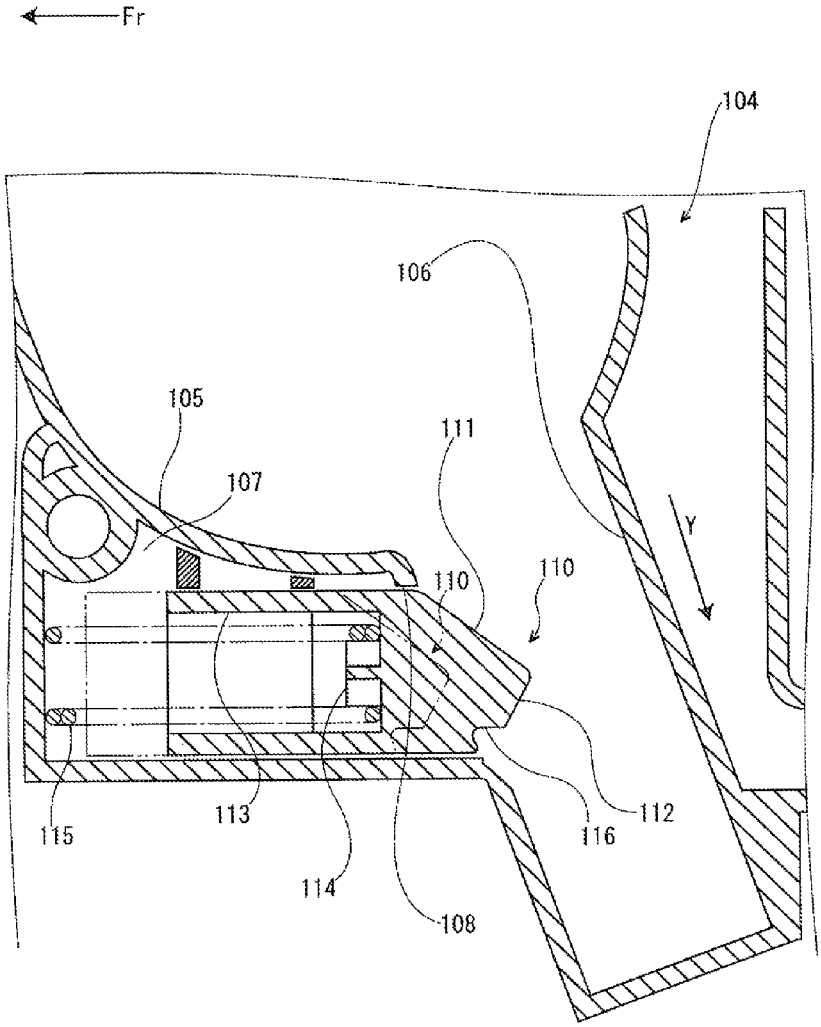
FIG. 10 is a sectional view showing a locking member in the printer according to the embodiment of the present disclosure.

Next, with reference to FIGS. 7-10, the development device 12 will be described in detail. FIG. 7 is a schematic diagram schematically showing the image forming unit in the printer according to an embodiment of the present disclosure. FIG. 8 is a front left perspective view showing the image forming unit in the printer according to the embodiment of the present disclosure. FIG. 9 is a back right perspective view showing the image forming unit in the printer according to the embodiment of the present disclosure. FIG. 10 is a sectional view showing the locking member in the printer according to the embodiment of the present disclosure.

As shown in FIG. 7, the development device 12 is integrated with the photosensitive drum 10, charger 11 and cleaning device 14 so that an image forming unit 85 is composed. The image forming unit 85 is configured to be pulled out of the printer main body 2 in an upper forward direction and detachably installed in the printer main body 2.

The development device 12 is provided with a box-formed development device main body 86. At the center inside the development device main body 86, a partition 87 extending in upper and lower directions or a perpendicular direction is formed and, in front and behind the partition 87, stirring members 88 are respectively installed. Each stirring member 88 is rotatably supported onto the development device main body 86. Inside the development device main body 86, below and behind the rear stirring member 88, a developing roller 90 is installed. The developing roller 90 is rotatably supported onto the development device main body 86 and comes into contact with the surface of the photosensitive drum 10.

As shown in FIG. 8, on the top surface side of a top wall 91 of the development device main body 86, an installed part 92 is provided so that the toner container 6 is detachably installed into the installed part 92 as follows. In a right side part of the installed part 92, a replenishment port 93 is bored in the perpendicular direction, and around the replenishment port 93, a sealing member 94 is fixedly attached. The sealing member 94 is made of elastic material, e.g. sponge. In the sealing member 94, a replenishment aperture 95 is formed at a correspondent position to the replenishment port 93.

In the installed part 92, a development device side shutter 96 is attached. The development device side shutter 96 is formed in an extended plane-liked shape in the horizontal direction. At a left end of the development device side shutter 96, a supporting pivot 97 is provided so that the development device side shutter 96 turns around the supporting pivot 97 in a forward or backward direction along the top surface side of the top wall 91 of the development device main body 86, thereby opening or closing the replenishment port 93 and replenishment aperture 95.

On a front end of the installed part 92, a handle 99 is formed. On the right end of the installed part 92, a driving mechanism 98 is protrusively attached. The driving mechanism 98 includes a drive coupling 100 in the form of a triangle pole in a side view which is connected with a drive unit (not shown), such as a motor.

On a right end of the installed part 92, a fixing member 101 is protrusively attached behind the driving mechanism 98. On a left surface (an inside surface) of the fixing member 101, a line-formed guiding gap 102 is formed along the installing direction (refer to arrow Y in FIG. 8). On the rear bottom side of the guiding gap 102 (at a far side in the installing direction), a fixing gap 103 is formed with a circular section.

As shown in FIG. 9, on a left end of the installed part 92, a locking member 104 is protruded. On a right surface (an inside surface) of the locking member 104, a guiding depression 105 is formed in an arc shape curved in a downward direction. As shown in FIG. 10, on the right surface of the locking member 104, an insertion depression 106 connected with a lower end of the guiding depression 105 is formed. The insertion depression 106 is arranged along the installing direction (refer to arrow Y in FIG. 10). As shown in FIGS. 12A-12D, in the insertion depression 106, there are provided a first position A1, a second position A2 being further than the first position A1 in the installing direction and a third position A3 being further than the second position A2 in the installing direction.

As shown in FIG. 10 and other figure, in front of the insertion depression 106, a housing part 107 is arranged to extend in the forward and backward directions. The housing part 107 communicates into the insertion depression 106 via a communication hole 108. In the housing part 107, an engaging piece 110 is housed. The engaging piece 110 is configured to move between a protrusive position (refer to solid line in FIG. 10) protruded to the insertion depression 106 at predetermined length and a withdrawn position (refer to two-dot chain line in FIG. 10) withdrawn further than the protrusive position from the insertion depression 106 in intersecting directions (the forward and backward directions in the embodiment) with the installing direction.

In a part of the engaging piece 110 to be protruded to the insertion depression 106, a first inclined face 111 is formed to incline so as to go toward the far side in the installing direction and protrude to the insertion depression 106. In the engaging piece 110, a second inclined face 112 is formed in succession from the first inclined face 111. The second inclined face 112 is arranged at a further side than the first inclined face 111 in the installing direction. The second inclined face 112 inclines to go toward the far side in the installing direction and withdraw from the insertion depression 106. In the engaging piece 110, an engaging depression 116 is formed at a further side than the second inclined face 112 in the installing direction. At the front side of the engaging piece 110, a spring depression 113 is formed and, in spring depression 113, a spring reception 114 is formed. Between the spring reception 114 and housing part 107, a coil spring 115 as a biasing member is installed so that the engaging piece 110 is biased to the protrusive position side by the coil spring 115.

Figure 11:
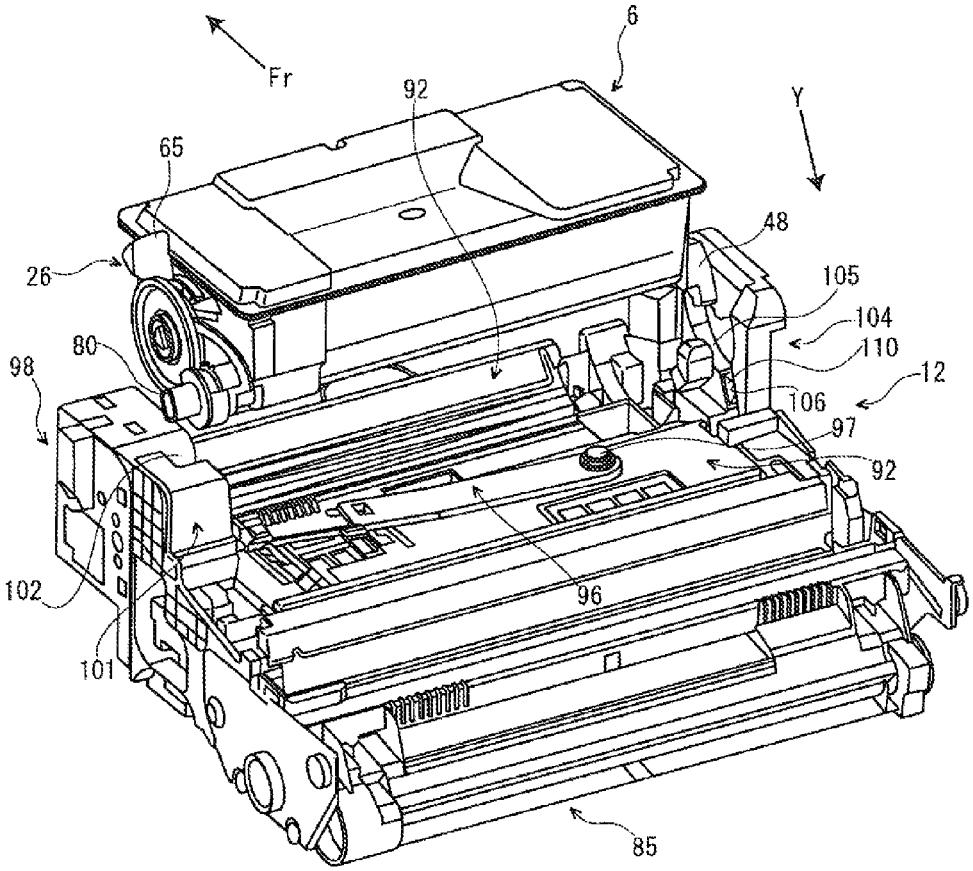
FIG. 11 is a back right perspective view showing the printer in a situation, in which the toner container is held above a development device, according to the embodiment of the present disclosure.
Figure 12A:
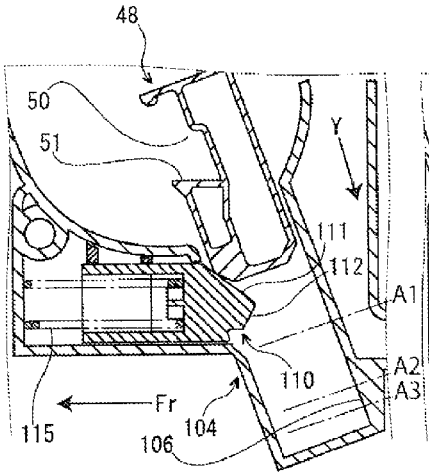
FIGS. 12A to 12D are sectional views showing the printer, in respective stages of fixing of a locking piece to the locking member, according to the embodiment of the present disclosure.
Figure 12C:
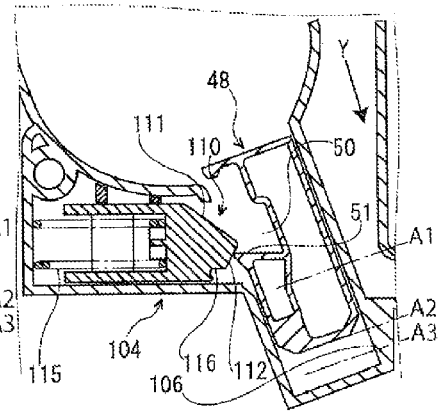
Figure 13A:
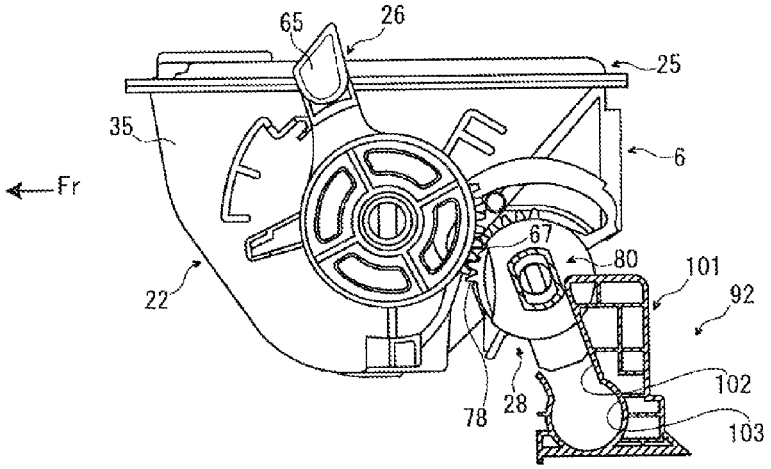
FIGS. 13A to 13C are sectional views showing the printer, in respective stages of fixing of a fixing piece to a fixing member, according to the embodiment of the present disclosure.
Figure 13B:
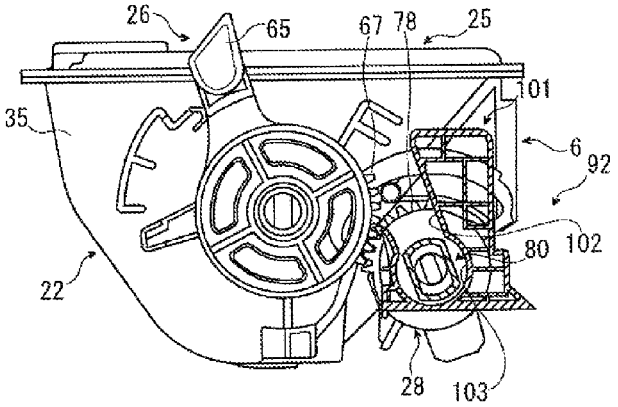
Figure 13C:
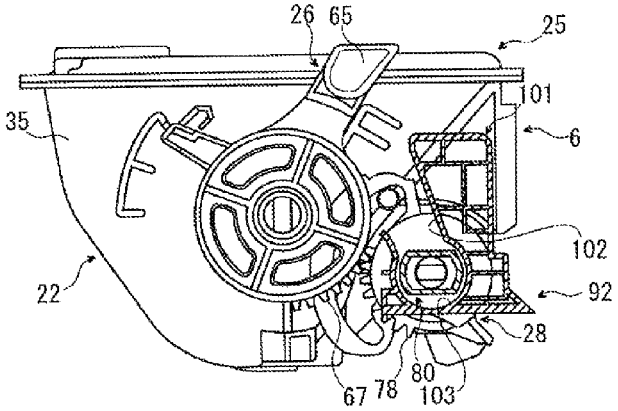
Figure 14:
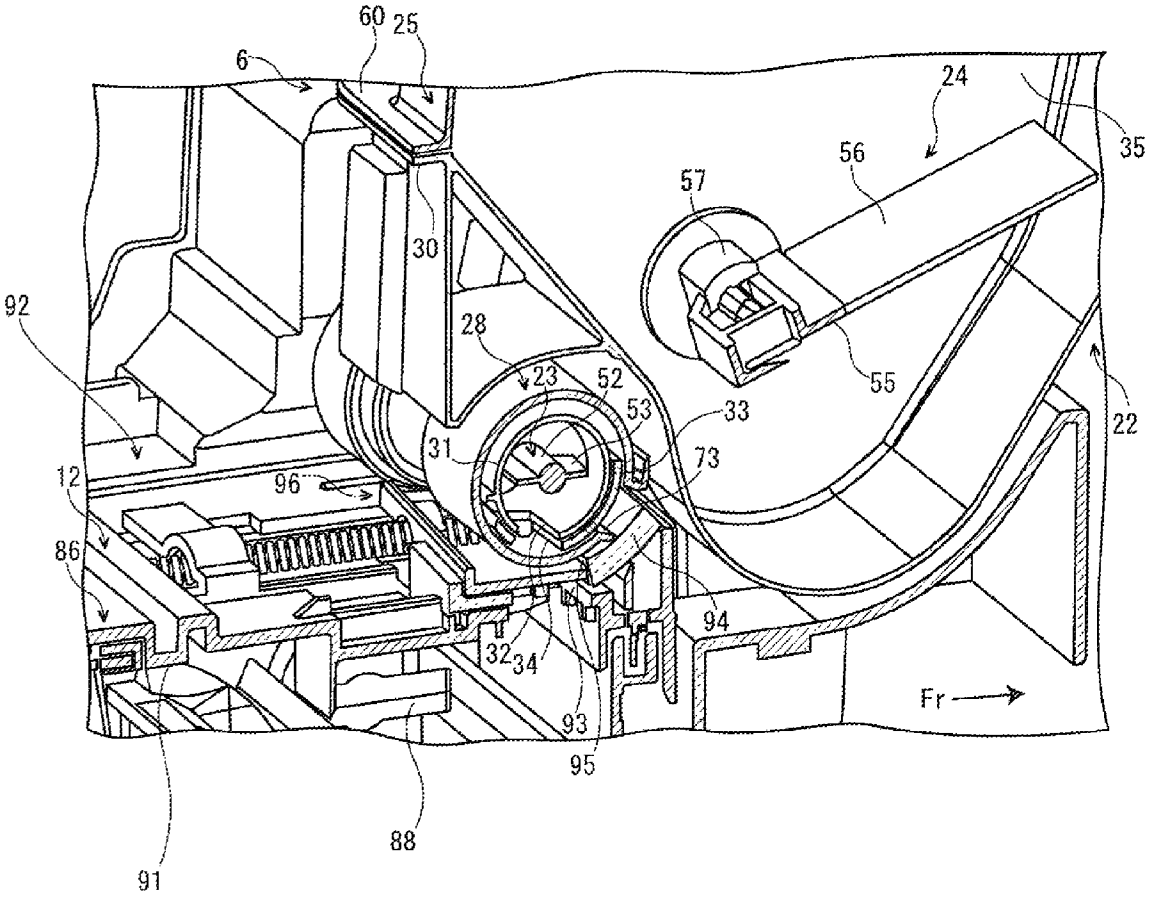
FIG. 14 is a back left perspective sectional view showing the printer in a situation, in which the case side shutter closes the discharge port and the development device side shutter closes the replenishment port, according to the embodiment of the present disclosure.
Figure 15:
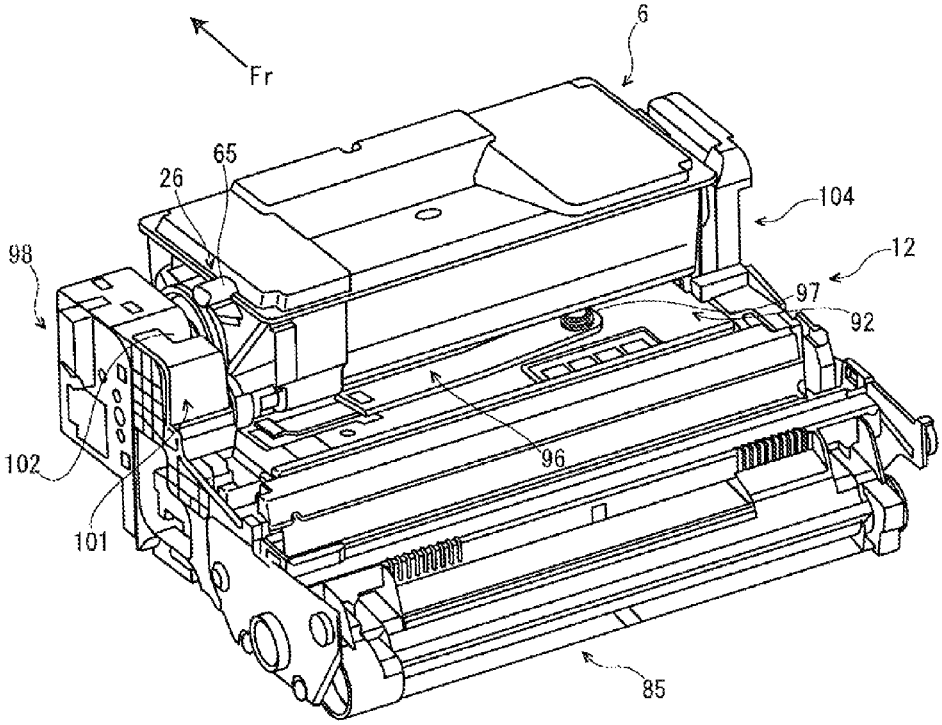
FIG. 15 is a back right perspective view showing the printer in a situation, in which the toner container is installed to an installed part of the development device, according to the embodiment of the present disclosure.

In the aforementioned configuration, a method of installing the toner container 6 into the installed part 92 of the development device 12 will be described with reference to FIGS. 11-15. FIG. 11 is a back right perspective view showing the printer in a situation, in which the toner container is held above the development device, according to the embodiment of the present disclosure. FIGS. 12A to 12D are sectional views showing the printer, in respective stages of fixing of the locking piece to the locking member, according to the embodiment of the present disclosure. FIGS. 13A to 13C are sectional views showing the printer, in respective stages of fixing of a fixing piece to a fixing member, according to the embodiment of the present disclosure. FIG. 14 is a back left perspective sectional view showing the printer in a situation, in which the case side shutter closes the discharge port and the development device side shutter closes the replenishment port, according to the embodiment of the present disclosure. FIG. 15 is a back right perspective view showing the printer in a situation, in which the toner container is installed in an installed part of the development device, according to the embodiment of the present disclosure. The transmitting member 27 is omitted in FIG. 13.

In order to install the toner container 6 into the installed part 92 of the development device 12, first, as shown in FIG. 11, after the toner container 6 is held above the development device 12, the toner container 6 is taken down to the development device 12 along the installing direction (refer to arrow Y in FIG. 11). Then, the locking piece 48 of the toner container 6 is guided by the guiding depression 105 and taken down so that the locking piece 48 is inserted to the insertion depression 106 with the lower end foremost. Accordingly, as shown in FIG. 12A, the lower end of the locking piece 48 comes into contact with the first inclined face 111 of the engaging piece 110.

Figure 12B:
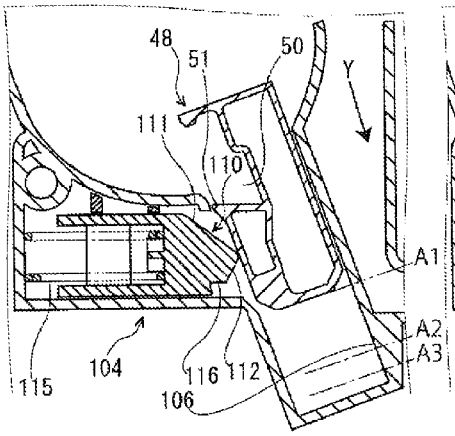

Subsequently to such a situation, as shown in FIG. 12B, when the locking piece 48 is more taken down and the lower end of the locking piece 48 is inserted to the first position A1 in the insertion depression 106, the lower end of the locking piece 48 presses the first inclined face 111 of the engaging piece 110 and the engaging piece 110 moves from the protrusive position to the withdrawn position against biasing force of the coil spring 115. At this moment, the first inclined face 111 of the engaging piece 110 presses the locking piece 48 toward a near side in the installing direction.

Subsequently to such a situation, as shown in FIG. 12C, when the locking piece 48 is further taken down and the lower end of the locking piece 48 is inserted to the second position A2 being further than the first position A1 in the installing direction, the second inclined face 112 of the engaging piece 110 comes into contact with the engaging protrusion 51 of the locking piece 48. Accordingly, the second inclined face 112 of the engaging piece 110 presses the engaging protrusion 51 of the locking piece 48 toward the far side in the installing direction by the biasing force of the coil spring 115.

Figure 12D:
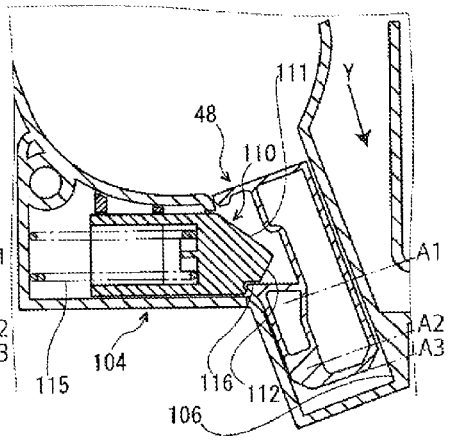

Subsequently to such a situation, as shown in FIG. 12D, when the locking piece 48 is furthermore taken down and the lower end of the locking piece 48 is inserted to the third position A3 being further than the second position A2 in the installing direction, the contact state of the second inclined face 112 of the engaging piece 110 with the engaging protrusion 51 of the locking piece 48 is released. Then, the engaging piece 110 moves from the withdrawn position to the protrusive position by the biasing force of the coil spring 115 and the engaging protrusion 51 of the locking piece 48 engages with the engaging depression 116 of the engaging piece 110. Accordingly, the engaging piece 110 stops the locking piece 48 in an engaged state so that the movement of the locking piece 48 toward the near side in the installing direction is restricted. In addition, a top end (a back end) of the engaging piece 110 is inserted to the depression 50 of the locking piece 48.

Moreover, as shown in FIG. 13A, in a situation before the toner container 6 is installed to the installed part 92 of the development device 12, the fixing piece 80 is separated from the fixing member 101. Subsequently to this situation, when the toner container 6 is installed to the installed part 92 of the development device 12, as shown in FIG. 13B, the fixing piece 80 passes through the guiding gap 102 and is engaged with the fixing gap 103.

In such a situation, when the gripper 65 of the lever 26 is tilted backward so that the lever 26 turns, accompanying to this turn, the case side shutter 28 connected with the lever 26 turns on the case main body 22. In accordance with the turn of the case side shutter 28, as shown in FIG. 13C, a phase of the fixing piece 80 to the fixing gap 103 is varied, and then, the release of the engagement of the fixing piece 80 and the fixing gap 103 are restricted. Thereby, the right end of the toner container 6 is shifted from a released state to a fixed state to the installed part 92 of the development device 12.

On the other hand, in a situation before the gripper 65 of the lever 26 is tilted backward, as shown in FIG. 14, the case side shutter 28 closes the discharge port 32 of the case main body 22. Subsequently to this situation, as mentioned above, when the gripper 65 of the lever 26 is tilted backward so that the case side shutter 28 turns, as shown in FIG. 3, the case side shutter 28 opens the discharge port 32 of the case main body 22. In addition, accompanying to the above-mentioned turn of the case side shutter 28, the pressing protrusion 83 of the case side shutter 28 presses the development device side shutter 96 backward. Accompanying to this press, the development device side shutter 96 turns backward and the development device side shutter 96 opens the replenishment port 93 of the development device 12. Thereby, it is possible to feed the toner from the toner container to the development device 12.

Thus, when the toner container 6 is installed to the installed part 92 of the development device 12, as shown in FIG. 15, the left face of the left end wall 43 of the toner container 6 is covered by the locking member 104 and the right end of the case side shutter 28 is covered by the fixing member 101.

In the embodiment, as described above, when the lower end of the locking piece 48 is inserted to the second position A2 of the insertion depression 106, the second inclined face 112 of the engaging piece 110 presses the locking piece 48 toward the far side in the installing direction by the biasing force of the coil spring 115. It is therefore possible to decrease force required to move the toner container toward the far side in the installing direction. Accordingly, it is possible to decrease a working load of workers, such as a user or a serviceman, undertaking installation/detachment work of the toner container 6. In addition, when the lower end of the locking piece 48 is inserted to the third position A3 of the insertion depression 106, the locking piece 48 is stopped in an engaged state by the engaging piece 110, thereby securely fixing the toner container 6 to the installed part 92.

Moreover, the second inclined face 112 of the engaging piece 110 is formed in succession from the first inclined face 111. It is therefore possible to facilitate the shift from a state of pressing the first inclined face 111 of the engaging piece 110 by the locking piece 48 to another state of pressing the engaging protrusion 51 of the locking piece 48 by the second inclined face 112 of the engaging piece 110.

Furthermore, the lever 26 is connected with the case side shutter 28. It is therefore possible to simultaneously carry out opening and closing of the discharge port 32 accompanying to the shift between the fixed state and released state of the right end of the toner container 6, thereby further decreasing a working load of workers undertaking installation/detachment work of the toner container 6. Because the fixing piece 80 of the case side shutter 28 is engaged with the fixing gap 103 of the fixing member 101, it is possible to more securely fix the toner container 6 to the installed part 92. Particularly, because the embodiment is configured to rigidly fix both ends of the toner container 6 to the installed part 92, even if the toner container 6 is grabbed and the image forming unit 85 is pulled out or detached, it is possible to prevent unintentional disconnect of the toner container 6 from the installed part 92.

In addition, the locking piece 48 is formed in an extended-shape in the installing direction. Therefore, when the toner container 6 is installed to and detached from the installed part 92, the locking piece 48 is guided along the installing direction by the insertion depression 106, thereby stabilizing a posture of the toner container 6.

Figure 16A:
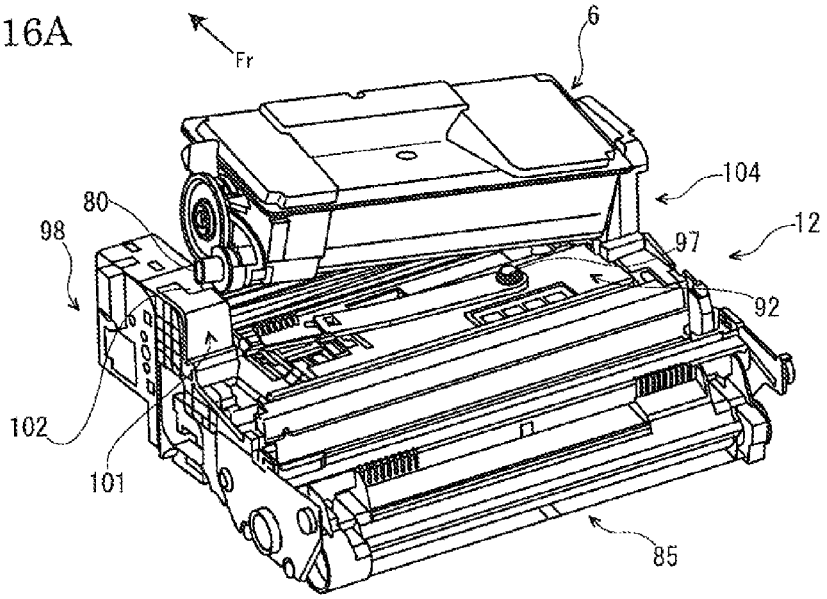
FIGS. 16A and 16B are sectional views showing the printer, in respective stages of detachment of the toner container from the installed part of the development device, according to the embodiment of the present disclosure.
Figure 16B:
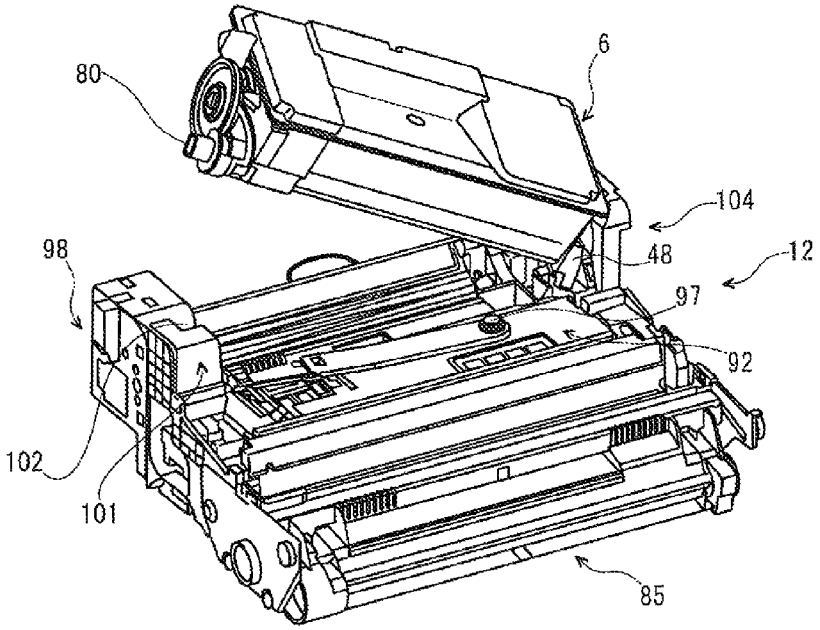

Next, a method of detaching the toner container 6 from the installed part 92 of the development device 12 will be described with reference to mainly FIGS. 13 and 16. FIGS. 13A to 13C are sectional views showing the printer, in respective stages of fixing of a fixing piece to a fixing member, according to the embodiment of the present disclosure. FIGS. 16A and 16B are sectional views showing the printer, in respective stages of detachment of the toner container from the installed part of the development device, according to the embodiment of the present disclosure.

First, as shown in FIG. 13C, after a situation in which the gripper 65 of the lever 26 is tilted backward, the gripper 65 of the lever 26 is tilted forward. Accordingly, as shown in FIG. 13B, a phase of the fixing piece 80 to the fixing gap 103 is varied, and then, the engagement of the fixing piece 80 and the fixing gap 103 is made releasable, thereby shifting the right end of the toner container 6 from the fixed state to the released state to the installed part 92.

In such a situation, as shown in FIG. 13A, the fixing piece 80 is removed from the fixing member 101. Then, because the locking piece 48 is still stopped in an engaged state by the engaging piece 110, as shown in FIG. 16A, the right end side of the toner container 6 turns around the left end side in a separating direction (in the embodiment, an upper direction) from the installed part 92. Thereby, the engaged stop of the locking piece 48 with the engaging piece 110 is made releasable, and therefore, as shown in FIG. 16B, it is possible to detach the toner container 6 from the installed part 92 of the development device 12.

In the embodiment, as described above, without configuring the installed part 92 to include a mechanism for releasing the fixed state of the toner container 6 to the installed part 92, it is possible to detach the toner container 6 from the installed part 92.

Although the embodiment was described in case of forming the lever 26 and case side shutter 28 separately from each other, as another embodiment, the lever 26 and case side shutter 28 may be formed in a body.

Although ideas of the disclosure are applied into the toner container 6 in the embodiment, as a further embodiment, the ideas of the disclosure may be applied into another toner case (so-called "an intermediate hopper") interposed between the toner container 6 and development device 12.

Although the embodiment was described in a case where ideas of the disclosure are applied into the printer 1, as a furthermore embodiment, the ideas of the disclosure may be applied into another image forming apparatus except the printer 1, such as a copying machine, a facsimile or a multi-function machine.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. An image forming apparatus comprising:

a toner case including a discharge port configured to discharge a toner, and an installed part to which the toner case is detachably installed, wherein, on the circumference of the toner case, a locking piece is provided, the installed part includes a locking member configured to cover at least apart of the circumference of the toner case, the locking member includes:

an insertion depression arranged along an installing direction of the toner case to the installed part and configured to be capable of insertion of the locking piece;

an engaging piece configured to move between a protrusive position arranged to protrude to the insertion depression at predetermined length and a withdrawn position arranged to withdraw further than the protrusive position from the insertion depression in intersecting directions with the installing direction; and a biasing member configured to bias the engaging piece to the protrusive position side, in the insertion depression, a first position, a second position being further than the first position in the installing direction and a third position being further than the second position in the installing direction are provided, while the toner case is installed to the installed part, when the locking piece is inserted to the first position, the locking piece presses the engaging piece so that the engaging piece moves from the protrusive position to the withdrawn position against biasing force of the biasing member, when the locking piece is inserted to the second position, the engaging piece presses the locking piece to the far side in the installing direction by biasing force of the biasing member, and when the locking piece is inserted to the third position, the engaging piece stops the locking piece in an engaged state so that the movement of the locking piece toward the near side in the installing direction is restricted.

2. The image forming apparatus according to claim 1, wherein the engaging piece has:

a first inclined face configured to incline so as to go toward the far side in the installing direction and protrude to the insertion depression; and a second inclined face configured, at a further side than the first inclined face in the installing direction in succession from the first inclined face, to incline so as to go toward the far side in the installing direction and withdraw from the insertion depression, and when the locking piece is inserted to the first position, the locking piece presses the first inclined face, and when the locking piece is inserted to the second position, the second inclined face presses the locking piece.

3. The image forming apparatus according to claim 1, wherein one end of the toner case is provided with the locking piece, while another end of the toner case is provided with a lever configured to shift the other end to a fixed state or a released state to the installed part, while the toner case is detached from the installed part, when a lever is operated to shift the other end from the fixed state to the released state, the other end side turns around the one end side in a separating direction from the installed part so that the engaged stop of the locking piece with the engaging piece is made releasable.

4. The image forming apparatus according to claim 3, wherein the other end of the toner case is provided with a shutter connected with the lever and the shutter is configured to open/close the discharge port accompanying to the operation of the lever.

5. The image forming apparatus according to claim 4, wherein the shutter has a fixing piece with an elliptic section and is rotatably provided, the installed part includes a fixing member configured to cover at least a part of the shutter and the fixing member has a fixing gap with a circular section configured to be capable of insertion of the fixing piece, when the toner case is installed to the installed part, the fixing piece is engaged with the fixing gap, and when the lever is operated in a situation in which the toner case is installed to the installed part, the shutter turns to make a phase of the fixing piece to the fixing gap varied, and then, the release of the engagement of the fixing piece and the fixing gap are restricted so that the other end of the toner case is shifted from the released state to the fixed state.

6. The image forming apparatus according to claim 1, wherein the locking piece is formed in an extended-shape in the installing direction.

7. The image forming apparatus according to claim 1, wherein the engaging piece has an engaging depression, the locking piece has an engaging protrusion, and when the locking piece is inserted to the third position, the engaging protrusion is engaged with the engaging depression.

8. The image forming apparatus according to claim 1, wherein the locking piece has a depression, and when the locking piece is inserted to the third position, at least a part of the engaging piece is inserted to the depression.

9. The image forming apparatus according to claim 1, wherein the biasing member is a coil spring.

10. A toner case detachably installed to an installed part of an image forming apparatus comprising:

a discharge port configured to discharge a toner; and a locking piece provided on the circumference, wherein the installed part of the image forming apparatus includes a locking member configured to cover at least a part of the circumference of the toner case, the locking member includes:

an insertion depression arranged along an installing direction of the toner case to the installed part and configured to be capable of insertion of the locking piece;

an engaging piece configured to move between a protrusive position arranged to protrude to the insertion depression at predetermined length and a withdrawn position arranged to withdraw further than the protrusive position from the insertion depression in intersecting directions with the installing direction; and a biasing member configured to bias the engaging piece to the protrusive position side, in the insertion depression, a first position, a second position being further than the first position in the installing direction and a third position being further than the second position in the installing direction are provided, while the toner case is installed to the installed part, when the locking piece is inserted to the first position, the locking piece presses the engaging piece so that the engaging piece moves from the protrusive position to the withdrawn position against biasing force of the biasing member, when the locking piece is inserted to the second position, the engaging piece presses the locking piece to the far side in the installing direction by biasing force of the biasing member, and when the locking piece is inserted to the third position, the engaging piece stops the locking piece in an engaged state so that the movement of the locking piece toward the near side in the installing direction is restricted.

11. The toner case according to claim 10, wherein the engaging piece has:

a first inclined face configured to incline so as to go toward the far side in the installing direction and protrude to the insertion depression; and a second inclined face configured, at a further side than the first inclined face in the installing direction in succession from the first inclined face, to incline so as to go toward the far side in the installing direction and withdraw from the insertion depression, and when the locking piece is inserted to the first position, the locking piece presses the first inclined face, and when the locking piece is inserted to the second position, the second inclined face presses the locking piece.

12. The toner case according to claim 10, wherein one end of the toner case is provided with the locking piece, while another end of the toner case is provided with a lever configured to shift the other end to a fixed state or a released state to the installed part, while the toner case is detached from the installed part, when a lever is operated to shift the other end from the fixed state to the released state, the other end side turns around the one end side in a separating direction from the installed part so that the engaged stop of the locking piece with the engaging piece is made releasable.

13. The toner case according to claim 12, wherein the other end of the toner case is provided with a shutter connected with the lever and the shutter is configured to open/close the discharge port accompanying to the operation of the lever.

14. The toner case according to claim 13, wherein the shutter has a fixing piece with an elliptic section and is rotatably provided, the installed part includes a fixing member configured to cover at least a part of the shutter and the fixing member has a fixing gap with a circular section configured to be capable of insertion of the fixing piece, when the toner case is installed to the installed part, the fixing piece is engaged with the fixing gap, and when the lever is operated in a situation in which the toner case is installed to the installed part, the shutter turns to make a phase of the fixing piece to the fixing gap varied, and then, the release of the engagement of the fixing piece and the fixing gap are restricted so that the other end of the toner case is shifted from the released state to the fixed state.

15. The toner case according to claim 10, wherein the locking piece is formed in an extended-shape in the installing direction.

16. The toner case according to claim 10, wherein the engaging piece has an engaging depression, the locking piece has an engaging protrusion, and when the locking piece is inserted to the third position, the engaging protrusion is engaged with the engaging depression.

17. The toner case according to claim 10, wherein the locking piece has a depression, and when the locking piece is inserted to the third position, at least a part of the engaging piece is inserted to the depression.

18. The toner case according to claim 10, wherein the biasing member is a coil spring.

* * * * *